US010618709B1

(12) United States Patent
Seiders et al.

(10) Patent No.: US 10,618,709 B1
(45) Date of Patent: Apr. 14, 2020

(54) CONTAINER LIGHT

(71) Applicant: YETI Coolers, LLC, Austin, TX (US)

(72) Inventors: Roy Joseph Seiders, Austin, TX (US); Christopher M. Keller, Austin, TX (US); Kyle Thomas Miller, Austin, TX (US); Steve Charles Nichols, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 273 days.

(21) Appl. No.: 15/469,219

(22) Filed: Mar. 24, 2017

Related U.S. Application Data

(60) Provisional application No. 62/312,927, filed on Mar. 24, 2016.

(51) Int. Cl.

| | |
|---|---|
| ***B65D 51/24*** | (2006.01) |
| ***F21V 15/01*** | (2006.01) |
| ***F21L 4/00*** | (2006.01) |
| ***F21V 23/02*** | (2006.01) |
| ***F21V 23/04*** | (2006.01) |
| ***F21V 21/096*** | (2006.01) |
| ***F21V 21/08*** | (2006.01) |
| ***B65D 43/16*** | (2006.01) |
| ***B65D 81/38*** | (2006.01) |

(Continued)

(52) U.S. Cl.
CPC ..... *B65D 51/24* (2013.01); *B65D 43/164* (2013.01); *B65D 81/3813* (2013.01); *F21L 4/00* (2013.01); *F21V 15/01* (2013.01); *F21V 21/0808* (2013.01); *F21V 21/0965* (2013.01); *F21V 23/023* (2013.01); *F21V 23/0414* (2013.01); *F21V 23/0464* (2013.01); *F21V 23/0471* (2013.01); *B65D 45/02* (2013.01); *F21Y 2115/10* (2016.08)

(58) Field of Classification Search
CPC ..... F21V 23/0464; F21V 23/0471; F21V 23/0414; F21V 23/023; F21V 21/0808; F21V 21/0965; F21V 15/01; B65D 51/24; B65D 81/3813; B65D 43/164; F21L 4/00; F21Y 2115/10
See application file for complete search history.

(56) References Cited

U.S. PATENT DOCUMENTS

| | | | | |
|---|---|---|---|---|
| 2,644,882 A | | 7/1953 | Voda | |
| 3,860,847 A | * | 1/1975 | Carley | H01L 33/483 257/788 |
| 4,153,860 A | | 5/1979 | Vonick | |

(Continued)

FOREIGN PATENT DOCUMENTS

WO 2005074360 A2 8/2005

OTHER PUBLICATIONS

Coghlan's Cooler Light, [online] retrieved from internet on Nov. 11, 2015, URL: http://www.amazon.com/Coghlans-0902-Cooler-Light/dp/B001N7FIVU/ref=pd sim 468.

(Continued)

*Primary Examiner* — David V Bruce
(74) *Attorney, Agent, or Firm* — Banner & Witcoff, Ltd.

(57) ABSTRACT

A light having a housing portion and a base portion and wherein the housing portion is removably engaged with the base portion. The base portion may be engaged with an insulating device or other container and the light may be configured to turn on when the insulating device lid is opened.

18 Claims, 15 Drawing Sheets

(51) Int. Cl.
*F21Y 115/10* (2016.01)
*B65D 45/02* (2006.01)

(56) References Cited

U.S. PATENT DOCUMENTS 4,442,478 A 4/1984 Stansbury
4,754,376 A 6/1988 Winslow
4,855,881 A 8/1989 Pence
D336,350 S 6/1993 Stearns et al.
5,246,285 A 9/1993 Redburn et al.
5,257,169 A 10/1993 Walendziak
D362,314 S 9/1995 Shemitz
5,459,648 A 10/1995 Courtney
5,558,429 A 9/1996 Cain
D384,202 S 9/1997 Gilmore
5,685,421 A 11/1997 Gilmore
5,839,821 A 11/1998 LeZotte
5,879,072 A 3/1999 Huang
5,931,562 A 8/1999 Arato
5,969,437 A 10/1999 Foerster
6,053,315 A 4/2000 Yao
6,086,218 A 7/2000 Robertson
6,182,462 B1 2/2001 Bania et al.
6,249,089 B1 6/2001 Bruwer
6,267,484 B1 7/2001 Baker et al.
6,305,818 B1 10/2001 Lebens et al.
6,357,893 B1 3/2002 Belliveau
6,474,833 B1 11/2002 Parsons et al.
6,519,965 B1 2/2003 Blanchard, Sr. et al.
6,642,667 B2 11/2003 Avis
6,726,341 B2 4/2004 Pashley et al.
6,749,319 B1 6/2004 Muse
6,848,807 B2 2/2005 Guerrieri
6,957,897 B1 10/2005 Nelson et al.
6,981,780 B2 1/2006 Einav
6,994,451 B2 2/2006 Galli
6,997,007 B1 2/2006 Wyatt
7,033,040 B2 4/2006 Spahr et al.
7,055,983 B1 6/2006 Baker et al.
7,080,920 B2 7/2006 Fitzsimmons et al.
7,083,299 B2 8/2006 Chapman
7,106,007 B2 9/2006 Tsao
7,106,378 B2 9/2006 Kawakami
7,123,130 B2 10/2006 Bolta
7,185,999 B2 3/2007 Lui
7,186,002 B2 3/2007 Matthews et al.
7,220,016 B2 5/2007 Matthews et al.
D549,382 S 8/2007 Lee
7,267,454 B2 9/2007 Yuen
7,279,688 B2 10/2007 Campman
7,281,815 B1 10/2007 Gustafson et al.
7,287,873 B2 10/2007 Galli
7,364,319 B2 4/2008 Canella
7,394,211 B1 7/2008 Kuhlmann
7,410,271 B1 8/2008 Man
D581,569 S 11/2008 Levine
7,452,099 B2 11/2008 Evans et al.
7,549,765 B2 6/2009 Kim et al.
7,549,766 B2 6/2009 Sharrah et al.
7,553,043 B2 6/2009 Venn
7,646,973 B2 1/2010 Howard et al.
7,649,323 B1 1/2010 Kuhlmann et al.
7,722,204 B1 5/2010 Sandberg
7,806,552 B1 10/2010 St. Julien
7,942,555 B2 5/2011 Hadden
8,147,089 B2 4/2012 Matthews et al.
D658,798 S 5/2012 Hillard
8,201,977 B2 6/2012 Thomas et al.
8,210,702 B1 7/2012 Sandberg
8,297,775 B2 10/2012 Wright et al.
8,382,309 B1 2/2013 Johnston
D684,284 S 6/2013 Borovicka
D685,510 S 7/2013 Henry et al.
8,508,080 B2 8/2013 Avis
8,511,110 B2 8/2013 Kim
8,564,220 B2 10/2013 Matthews et al.
8,610,372 B2 12/2013 Rothschild
D702,865 S 4/2014 Yuen
8,721,103 B2 5/2014 Robinson
D706,478 S 6/2014 Yuen
8,833,961 B2 9/2014 Chen
8,979,297 B2 3/2015 Statham
9,046,230 B2 6/2015 O'Brien
9,080,736 B1 7/2015 Salzinger et al.
9,121,556 B1 9/2015 McDermott
9,127,831 B2 9/2015 Watanabe
9,127,874 B2 9/2015 Ye et al.
D744,786 S 12/2015 Bagwell
2002/0084890 A1* 7/2002 Guerrieri ..... H05B 37/0209 340/332
2003/0067767 A1 4/2003 Liu
2004/0100794 A1* 5/2004 Michael ..... F21S 9/032 362/183
2006/0279947 A1 12/2006 Henley et al.
2006/0289547 A1 12/2006 Ewing et al.
2007/0014105 A1 1/2007 Noguchi et al.
2007/0041180 A1 2/2007 Wallace
2007/0103895 A1 5/2007 Riesebosch
2007/0139916 A1 6/2007 Vermillion et al.
2007/0144196 A1 6/2007 Currie
2007/0171082 A1 7/2007 Melnik
2007/0171084 A1 7/2007 Potter
2007/0217187 A1 9/2007 Blakely et al.
2007/0285053 A1 12/2007 Noguchi et al.
2008/0043471 A1 2/2008 Musgrove et al.
2008/0170388 A1* 7/2008 Greil ..... F25D 27/00 362/155
2008/0272928 A1 11/2008 Shuster
2009/0290331 A1 11/2009 Jacobs
2010/0084997 A1 4/2010 Oberzeir et al.
2010/0126196 A1 5/2010 McCance
2010/0212344 A1 8/2010 Mattucci
2010/0219775 A1 9/2010 Maglica et al.
2010/0242520 A1 9/2010 Weir
2011/0075402 A1 3/2011 Andronicus
2011/0122609 A1 5/2011 Dahlin
2011/0204818 A1 8/2011 Spartano
2012/0008310 A1 1/2012 Staeubli et al.
2012/0102894 A1 5/2012 Terhaar et al.
2012/0112635 A1 5/2012 Cho et al.
2012/0206907 A1 8/2012 Seidel
2012/0256540 A1 10/2012 Batty et al.
2012/0257379 A1 10/2012 Herr et al.
2013/0176747 A1 7/2013 Sparrow
2014/0009906 A1 1/2014 Rolfes
2014/0027990 A1 1/2014 Triglia
2014/0035459 A1 2/2014 Windom et al.
2014/0043837 A1 2/2014 Michaud
2014/0191664 A1* 7/2014 Johnson ..... H05B 33/0857 315/152
2014/0226319 A1 8/2014 Howell
2014/0326562 A1 11/2014 Pickens et al.
2015/0003048 A1 1/2015 Chang
2015/0114024 A1 4/2015 Grepper
2015/0219389 A1 8/2015 Schaefer et al.
2015/0267956 A1 9/2015 Miller
2015/0276303 A1 10/2015 Preciat Cervera
2015/0300721 A1 10/2015 Rigoli
2015/0305111 A1 10/2015 Bortolotti et al.
2015/0308640 A1 10/2015 Miller
2015/0345717 A1 12/2015 Gerpheide et al.
2017/0105265 A1* 4/2017 Sadwick ..... A61N 5/0618

OTHER PUBLICATIONS

Coleman Auto-On LED Cooler Light, [online], retrieved from internet Nov. 11, 2015, URL: http://www.amazon.com/Coleman-2000006665-LED-Cooler-Light/dp/B00GVL1UVU.

* cited by examiner

CONTAINER LIGHT

CROSS-REFERENCE RELATED APPLICATIONS

This patent application claims the benefit of U.S. Provisional Patent Application No. 62/312,927 filed Mar. 24, 2016, entitled Portable Container Light which is incorporated by reference herein in its entirety.

FIELD

The present disclosure relates generally to lights, including portable lights, and lights configured for use with containers.

BACKGROUND

Lights such as flashlights and other similar devices may be used to light internal portions of containers such as coolers or insulating devices. Aspects of this disclosure relate to improved lights, including portable lights.

BRIEF SUMMARY

According to one aspect, a light is disclosed. According to another aspect, a light removably engaged with a container lid is disclosed. According to still another aspect, a light is disclosed which may be configured to automatically turn on when a container is opened. The light may include a light source which may be a light emitting diode (LED) array.

According to another aspect, a light and container system is disclosed. The container system may include a base portion having at least one inside surface; and a lid portion rotatable between an open position and a closed position, the lid portion rotatably, including hingedly, engaged with the base portion. The light may include a base portion, and a housing portion removably engaged with the base portion. The housing portion may include a switch, including a pushbutton, having a first position and a second position; a light emitting source; an acceleration sensor, configured to determine data related to movement of the light; a proximity sensor, configured to determine data related to proximity of at least one object to the light; a light sensor, configured to determine data related to ambient light; and a control unit configured to receive the data from each of the acceleration sensor, proximity sensor, and light sensor and configured to send instructions to the light emitting source. The control unit may be configured to automatically turn on the light emitting source in response to data received from at least one of the acceleration sensor, proximity sensor, and light sensor when the switch is in the first position.

According to other aspects, the light emitting source may be a light emitting diode array. The light may also be configured to activate when the switch is in the second position. The base portion of the light may be engaged with the container lid using adhesive. The base portion of the light may be engaged with the container lid using adhesive tape. The base portion of the light may be engaged with the container lid using mechanical fasteners. The container system may be an insulating device. The housing portion of the light may be configured to removably engage the base portion with at least one of: press fitting, snap fit mechanisms, or interference fit mechanisms. The housing portion of the light may be configured to removably engage the base portion with magnets. The light emitting source may be configured to activate when the container lid is opened to a predefined angle and wherein the predetermined angle is determined based on data received from the acceleration sensor; and the predetermined angle may be at least 15 degrees.

The light emitting source is configured to remain deactivated if the proximity sensor senses an inside surface of the container. The light emitting source may be configured to remain deactivated if the light sensor senses a predetermined amount of ambient light. At least one of the acceleration sensor, proximity sensor, and light sensor may be configured to operate in a hibernation state wherein the sensor uses less power as compared to a use state until a predetermined signal is received from the control unit. The proximity sensor may be configured to normally operate in a hibernation mode and does not determine data related to proximity of objects to the light; wherein the proximity enters a use state wherein it does determine data related to proximity of objects to the light once a predefined signal is received; and wherein the predetermined signal is data related to the predetermined angle.

According to another aspect, a light is disclosed. The light may include a base portion, and a housing portion removably engaged with the base portion. The housing portion includes a light emitting diode array; an acceleration sensor, configured to determine data related to movement of the light; a proximity sensor, configured to determine data related to proximity of at least one object to the light; a light sensor, configured to determine data related to ambient light; and a control unit configured to receive the data from each of the acceleration sensor, proximity sensor, and light sensor and configured to send instructions to the light emitting diode array.

According to other aspects the light may include a switch, including a push button, having a first position and a second position; wherein the control unit is configured to automatically activate the light emitting diode array in response to data received from at least one of the acceleration sensor, proximity sensor, and light sensor when the switch is in the first position. The light emitting diode array may be configured to activate when the light is moved a predefined movement and wherein the predetermined movement is determined based on data received from the acceleration sensor. The light emitting diode array may be configured to remain deactivated if the proximity sensor senses an inside surface of the container. The light emitting diode array may be configured to remain deactivated if the light sensor senses a predetermined amount of ambient light. The proximity sensor may be configured to normally operate in a hibernation mode and does not determine data related to proximity of objects to the light; wherein the proximity enters a use state wherein it does determine data related to proximity of objects to the light once a predefined signal is received; and wherein the predetermined signal is data related to the predetermined movement.

According to another aspect, a light is disclosed. The light may include a base portion, and a housing portion removably engaged with the base portion. The housing portion includes an internal lens housing within the housing portion, an internal frame within the internal lens housing, and light emitting diode array engaged with the internal frame and configured to provide light through the internal lens housing; and wherein the housing portion is configured to removably engage the base portion with at least one of: press fitting, snap fit mechanisms, or interference fit mechanisms; wherein the internal lens housing is waterproof.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present disclosure is illustrated by way of example and not limited in the accompanying figures in which like reference numerals indicate similar elements and in which.

Figure 1:
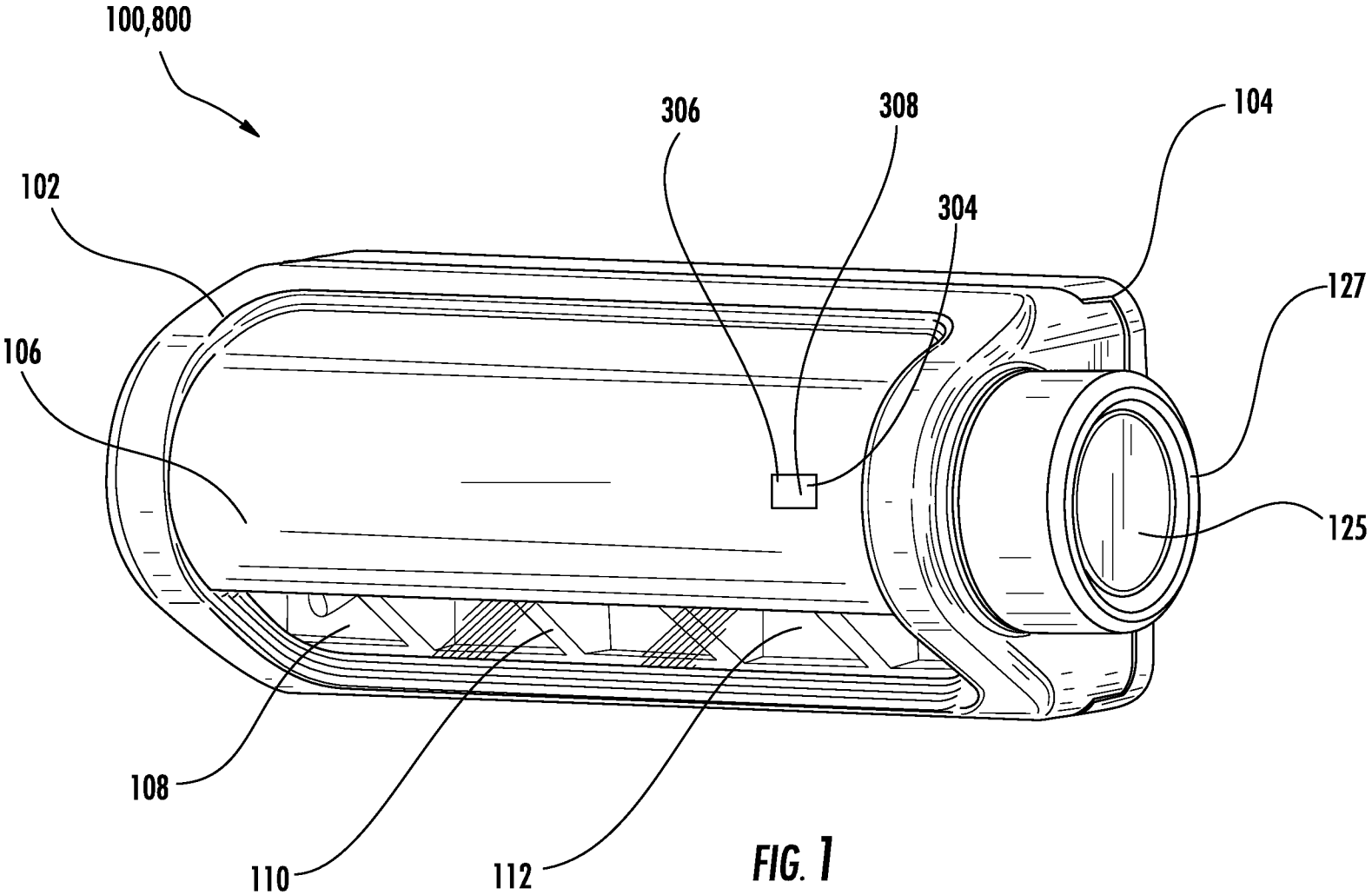
FIG. 1 depicts an isometric view of an example light, according to one or more aspects described herein.
Figure 2:
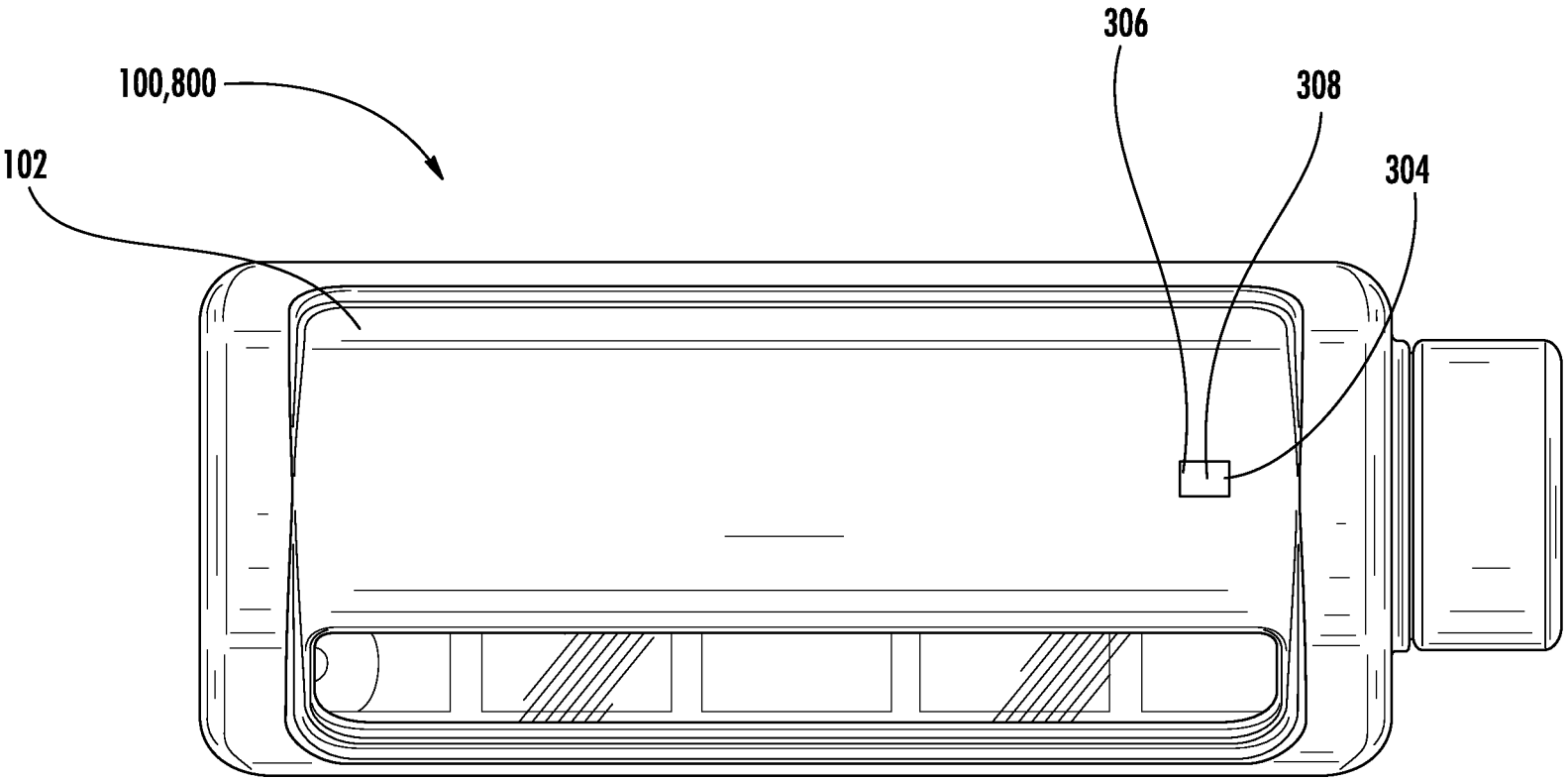
FIG. 2 depicts a top view of the example light of FIG. 1, according to one or more aspects described herein.

Further, it is to be understood that the drawings may represent the scale of different components of various examples; however, the disclosed examples are not limited to that particular scale.

DETAILED DESCRIPTION

While this invention is susceptible of embodiments in many different forms, there are shown in the drawings and will herein be described in detail exemplary embodiments of the invention with the understanding that the present disclosure is to be considered as an exemplification of the principles of the invention and is not intended to limit the broad aspects of the invention to the embodiments illustrated. It is to be understood that other embodiments may be utilized, and structural and functional modifications may be made, without departing from the scope and spirit of the present disclosure.

In the following description of the various embodiments, reference is made to the accompanying drawings, which form a part hereof, and in which is shown by way of illustration, various embodiments of the disclosure that may be practiced. It is to be understood that other embodiments may be utilized.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "upward," "downward," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this disclosure relate to systems of lights, including portable lights. According to various aspects and embodiments, the light may be formed of one or more of a variety of materials, such as metals (including metal alloys), plastics, polymers, and composites, and may be formed in one of a variety of configurations, without departing from the scope of the invention.

The various figures in this application illustrate examples of lights according to this disclosure. When the same reference number appears in more than one drawing, that reference number is used consistently in this specification and the drawings to refer to the same or similar parts throughout.

Figure 6:
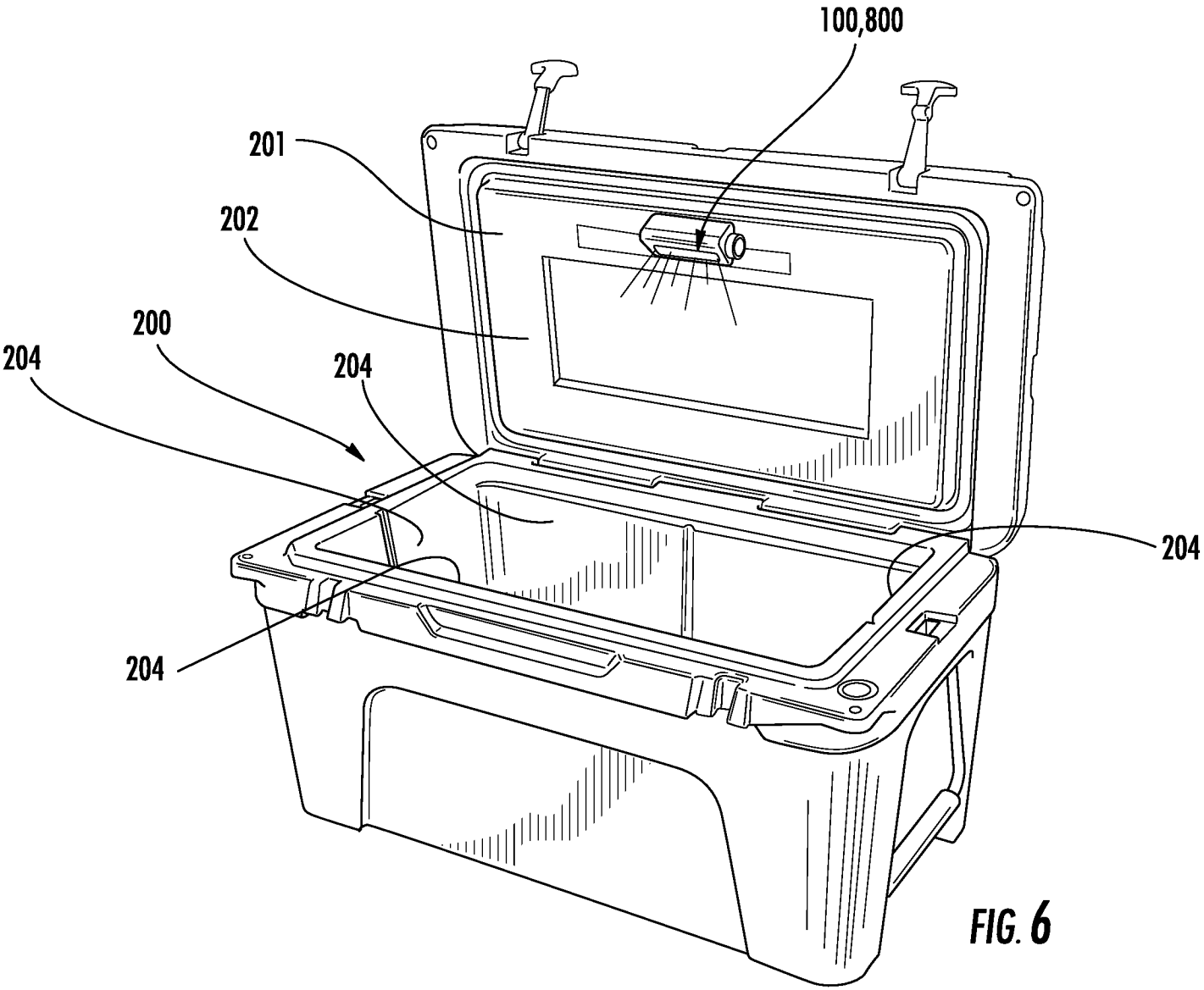
FIG. 6 depicts an isometric view of an example light engaged with an insulating device, according to one or more aspects described herein.

FIG. 1 depicts an isometric view of one example of a light 100, according to one or more aspects described herein. In particular, the light 100 includes a housing portion 102 and a base portion 104. The housing portion 102 and the base portion 104 may be removably engaged such that the housing portion 102 may be selectively removed or engaged with the base portion 104. As will be described in more detail below, and as shown in FIG. 6, the light 100 may be configured to engage with an insulating device 200 or other similar container or structure to illuminate the inside of the container or structure. As shown in FIG. 6 the container system or structure includes a base portion having at least one inside surface; and a lid portion 201 rotatable between an open position and a closed position and the lid portion 201 is rotatably, including hingedly, engaged with the base portion. In some embodiments, and as shown in FIG. 6, the base 104 may be engaged with an inside surface 202 of a container lid such as an insulating device lid 201. Thus, the housing portion 102, which is removably engaged with the base portion 104, can be removed from the container 200 by a user. In some examples, the housing portion 102 can be removed from the base portion 104 by a user using one hand and/or by moving the housing portion 102, such as by sliding, in a single direction. In embodiments, the housing portion 102 and the base portion 104 may be made of various materials. For example, the portions 102, 104 may be made of the same or different materials including metals, such as aluminum and plastics such as polycarbonate. In one example, the housing portion 102 may be made of aluminum and the base portion may be made of polycarbonate.

Referring now primarily to FIGS. 1-4, the housing portion 102 may have an outer shell 106. As shown in FIGS. 1-4, the outer shell 106 may have a generally semi-cylindrical shape although many other suitable shapes may be used, for example, rectangular, triangular, spherical, trapezoidal, rhomboidal, and the like. The outer shell 106 may include an aperture 108 into which a lens housing 110 may be engaged. The lens housing 110 may be engaged with the outer shell 106 creating a waterproof or water-resistant seal between the lens housing 110 and the outer shell 106 such that water may not enter the outer shell 106 through or around the lens housing 110. In other embodiments, the lens housing 110 may be integrally formed with the outer shell 106.

The lens housing 110 may include a light emitting source 112 such as a light bulb, a light emitting diode ("LED"), LED array or other similar device. The light emitting source 112 may be configured to activate (turn on) and deactivate (turn off). The light emitting source 112 may be configured to illuminate the inside of an insulating device 200. The light emitting source 112 may provide about 150 lumens, or at least 100 lumens, or approximately 100 to 300 lumens. The light emitting source 112 may have a wavelength of about 4500K to about 6000K or about 5500K to about 6000K.

Figure 3:
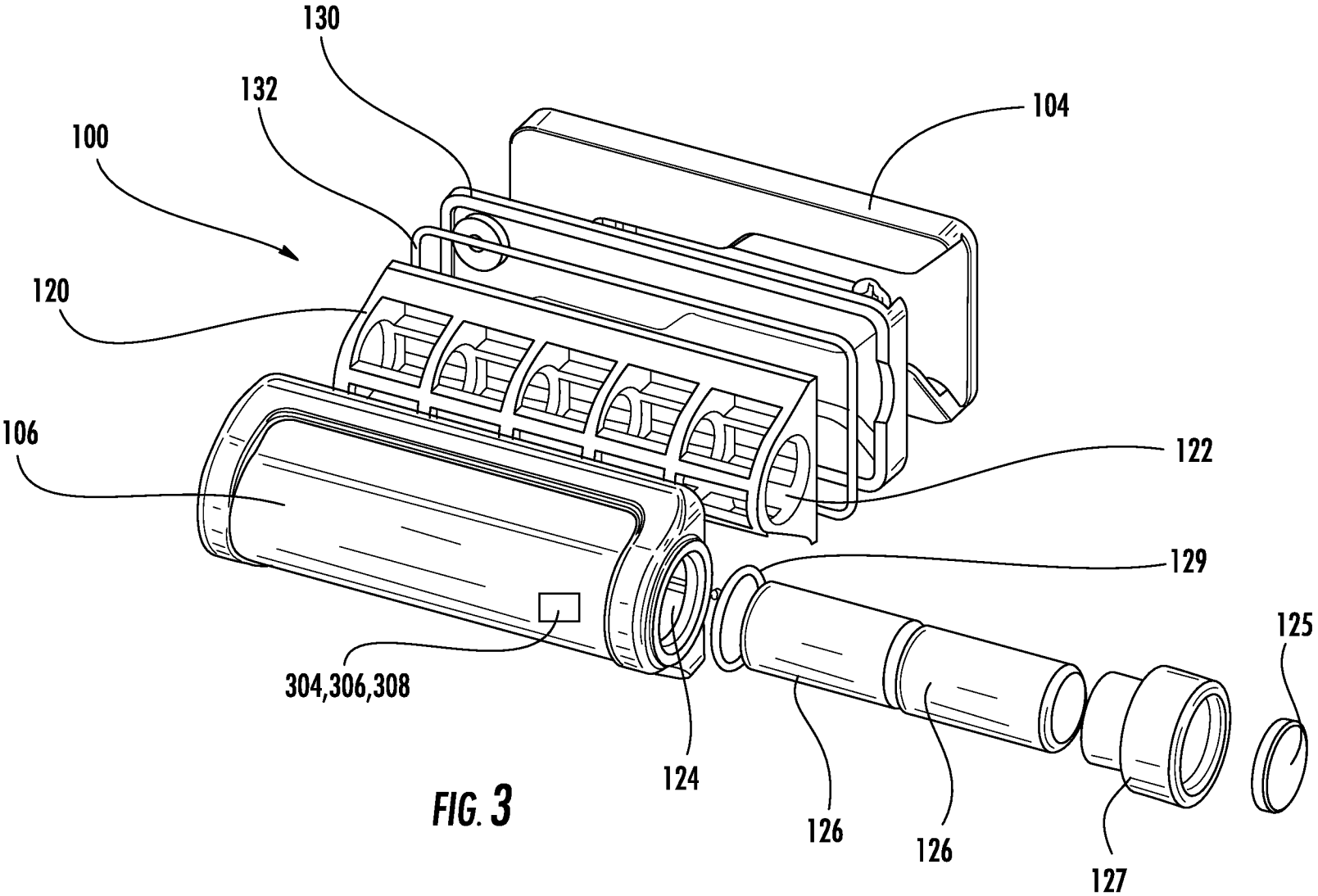
FIG. 3 depicts an isometric assembly view of the example light of FIG. 1, according to one or more aspects described herein.
Figure 4:
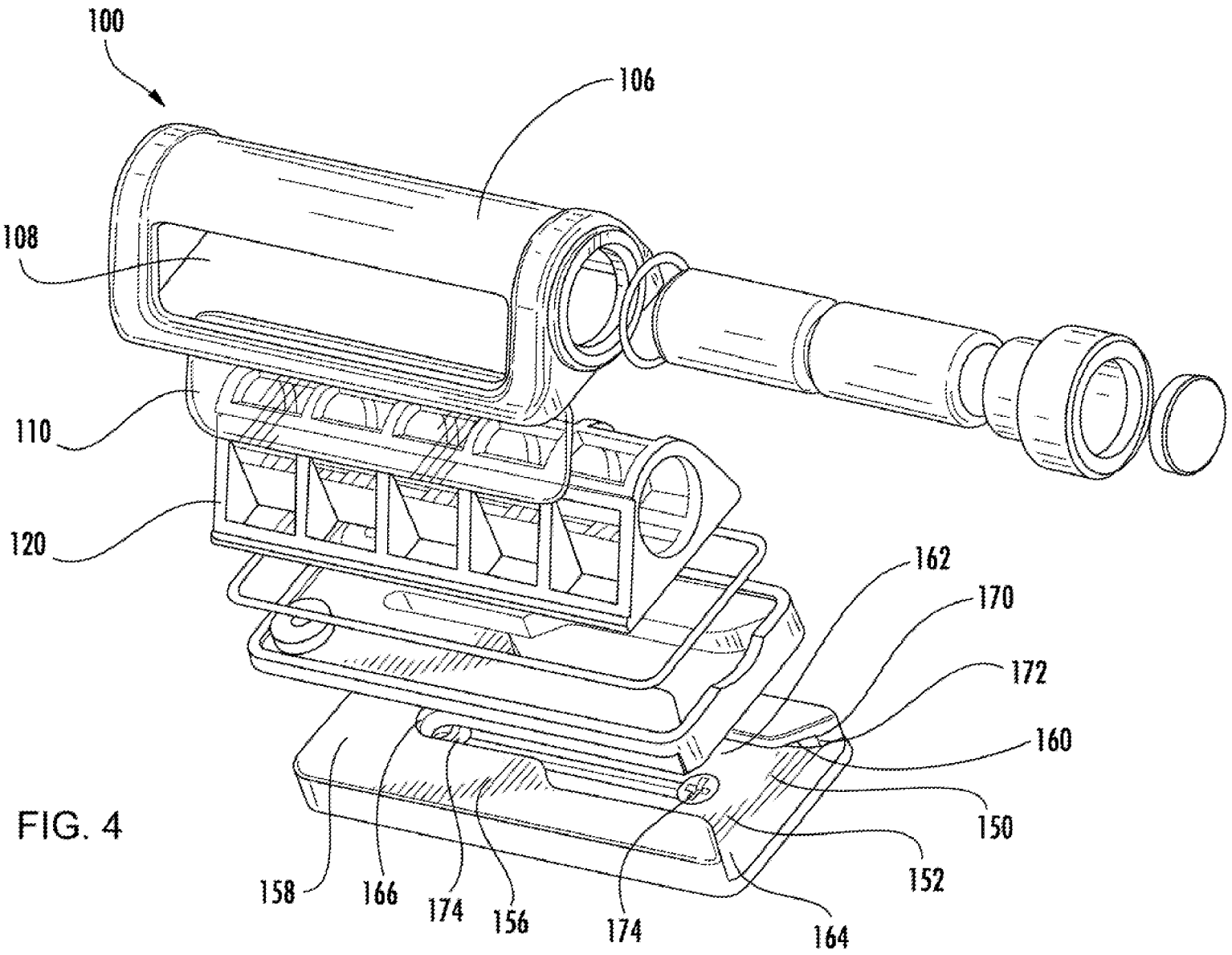
FIG. 4 depicts another isometric assembly view of the example light of FIG. 1, according to one or more aspects described herein.

As shown in FIGS. 3 and 4, the housing portion 102 may also include an internal frame 120. The internal frame 120 may generally be sized to fit within the housing portion 102. In some embodiments, the internal frame 120 may be sealed by adhesive or welding to the lens portion 120 providing a waterproof enclosure. The sealed internal frame 120 may align within the housing portion 102 and outer shell 106. In some embodiments, the internal frame 120 may include an aperture 122. In some embodiments, as shown for example in FIG. 3, the aperture 122 may be substantially cylindrical. When the internal frame 120 is engaged within the housing portion 102, the aperture 122 may align with an aperture 124 on the outer shell 106. As shown primarily in FIGS. 3 and 4, the internal frame 120 and the aperture 122 may be sized to accept one or more power source(s) 126 such as batteries or any other suitable power source. In some embodiments the power source(s) 126 may be lithium batteries such as CR 123A batteries. The internal frame 120 may be made of any suitable material including, for example, nylon.

The power source(s) 126 may be secured within the housing portion 106 by a cap 127 which may be removably engaged with the outer shell 106. For example, the cap 127 and the housing portion 106 may include a threaded engagement such that the cap 127 may screw into the housing portion 106. The cap 127 may engage with the outer shell 106 such that a watertight seal is created between the cap 127 and the outer shell 106. In some embodiments a gasket 129 may be included between the cap and the outer shell 106. As will be discussed in greater detail below, the cap 127 may also include a switch (such as a pushbutton) 125 for activating and/or controlling the light 100 and the light emitting source 112. The switch 125, may be a pushbutton switch (as shown in FIG. 3), a rotary switch, a toggle switch, a rocker switch, or any other suitable switch. The switch 125 may have positions indicating an automatic position, wherein the light emitting source 112 may automatically turn on or activate based on information from certain sensors; an "ON" position, wherein the light emitting source 112 is manually turned on or activated; and an "OFF" position, wherein the light emitting source 112 is manually turned off or deactivated. In some embodiments, the switch 125 may not include an "ON" where the light emitting source 112 can be manually turned on or activated. In some embodiments, the switch 125 may have at least a first position, in which the light may be operated automatically, and a second position, in which the light may be operated manually. In some embodiments, the first and second positions may correlate with first and second orientations of a switch, however, in other embodiments the first and second positions may correlate with an activation pattern of a single switch. For example, a user may press a switch for short period of time (e.g., less than 1 second) for the first position or press the switch for a long period of time (e.g., more than 2 seconds) for the second position. Similarly, a user may press a switch once for the first position and more than once for the second position.

The housing portion 102 may also include a bottom 130. The bottom 130 is configured to engage with the outer shell 106. The engagement between the outer shell 106 and the bottom 130 may be watertight such that liquid may not enter the housing portion 102 between the outer shell 106 and the bottom 130. In some embodiments the housing portion 102 may also include a gasket 132 between the bottom 130 and the outer shell 106 which may improve the engagement between the outer shell 106 and the bottom 130 such that the outer shell 106 does not shift relative to the bottom 130 during normal use of the container or insulating device. In still other embodiments, the outer shell 106 and the bottom 130 may be made of a single integral piece in a common injection molding process, for example. In embodiments, the outer shell 106 and the bottom 130 may be made of various materials. For example, the portions 106 and 130 may be made of the same or different materials including metals, such as aluminum and plastics such as polycarbonate. In one example, outer shell 106 may be made from a metal such as aluminum or an aluminum alloy and the base portion may be made of a thermoplastic such as polycarbonate.

Referring now primarily to FIG. 4, and as described briefly above, the housing portion 102 and the base portion 104 may be removably engaged such that the housing portion 102 may be selectively removed or engaged with the base portion 104. As shown in FIG. 4, the removable connection between the housing portion 102 and the base portion 104 may be an interference fit system. The removable connection may be engaged in a number of ways including, for example, by press fitting, snap fit mechanisms, or interference fit mechanisms. As shown in FIG. 4, the base portion 104 may have a base wall 150 which has a top surface 152 facing the housing portion 102 and a bottom surface (not shown) facing away from the housing portion 102. The base portion 104 may also include an upper wall 156 having a top surface 158 facing the housing portion 102 and a bottom surface 160 facing away from the housing portion 102. The upper wall 156 may include a channel 162 which may have an opening at a first end 164 and may be closed at a second end 166. As shown in FIG. 4, the channel 162 may taper such that it is wider at the first end 164 than at the second end 166.

The upper wall 158 of the base portion 104 may be connected to the base wall 150 by a connecting wall 170. The connecting wall 170 may provide a channel 172 between the upper wall 158 and the base wall 150. This channel 172 may be configured to interact with ridges (not shown) connected to a bottom surface of the housing bottom 130. The housing 102 may slide into the channels 162 and 170 and may removably lock within the base portion 104 through a snap-fit or friction fit connection. The housing portion 102 may be removed by sliding the housing portion 102 toward the first end 164.

Although one method of removably connecting the housing portion 102 to the base portion 104 is shown, many other removable connections may be used. In some examples, the housing portion 102 and/or the base portion 104 may include one or more magnets to hold the portions 102, 104 together. In another example, the housing portion 102 and base portion 104 may include a hook and loop fastening system. In still other examples the housing portion 102 and the base portion 104 may include a threaded fastening system such that the two portions may screw together. Additionally, ball and socket and bayonet connections are also contemplated. In still other embodiments, multiple methods of removably connecting the housing portion 102 to the base portion may be used. For example, as will be shown below with regard to the embodiment shown in FIG. 8, an interference fit system may be used along with a magnet system.

The housing 102 and the base portion 104 may be manufactured of aluminum or an aluminum alloy, such as A380 aluminum, or any other suitable material. The housing 102 and the base portion 104 may be manufactured using a die casting process. The housing 102 may be manufactured such that it is waterproof when tested for 30 minutes under 1 meter of water. In some embodiments, the housing 102 may be capable of achieving an IPX7 (as set forth by International Electrotechnical Commission) rating which specifies that ingress of water in harmful quantities is not possible when the enclosure is immersed in water under defined conditions of pressure and time (up to 1 m of submersion). The IPX7 test is 30 minutes long and the enclosure is tested with the lowest point of the enclosure 1000 mm below the surface of the water, or the highest point 150 mm below the surface whichever is deeper The light 100 may also be durable. For example, the light may be able to survive a drop test of at least 3 meters and still function properly. Additionally, the light may be able to survive a crush test of at least 500 pounds and still function properly.

The power source 126 may be able to power the light emitting source 112 for at least 8 hours, or in the range of about 8 to 15 hours of continuous use. The power source 126 may also function for at least 3 months when the light 100 is under normal use conditions.

As described above, the light 100 may be engaged with a container or other similar structure. As shown in FIG. 6, the light 100, may be engaged with an insulating device 200. An insulating device 200 or other container may have a lid 201 having an inside surface 202. The insulating device 200 or other container may also have a base portion 203 having inside surfaces or internal walls 204, including for example, front internal wall 204*a*, side internal walls 204*b* and 204*c*, and back internal wall 204*d*. The base portion 104 of the light may be connected to an inside surface 202 of an insulating device lid 201 or other similar structure. The base portion 104 may be connected to the insulating device lid 201 using mechanical fasteners 174 such as screws as shown in FIG. 4. In other examples, the base portion 104 may be connected to the insulating device using adhesives including adhesive tape. Adhesives which may be used that have a high bond strength when bonded to low energy plastics such as polyethelyne and polypropylene. One exemplary adhesive may include 3M™ Adhesive 300LSE tape. In still further examples, the base portion 104 may be integrally formed with the insulating device lid 201.

Although the light 100 has been described as mounting to an insulating device 200. The light may be engaged with other containers or objects having lids or covers including, for example, truck/job boxes, boat hatches, and toolboxes. Adhesives used to mount the light to the container may be capable of engaging the light to polyethylene, plastic, metals, including aluminum and steel, fiberglass, and painted surfaces. Once the light 100 is engaged with a surface, such as an insulating device lid 201, the light 100 may stay engaged with the lid 201 if it is slammed shut.

Figure 8:
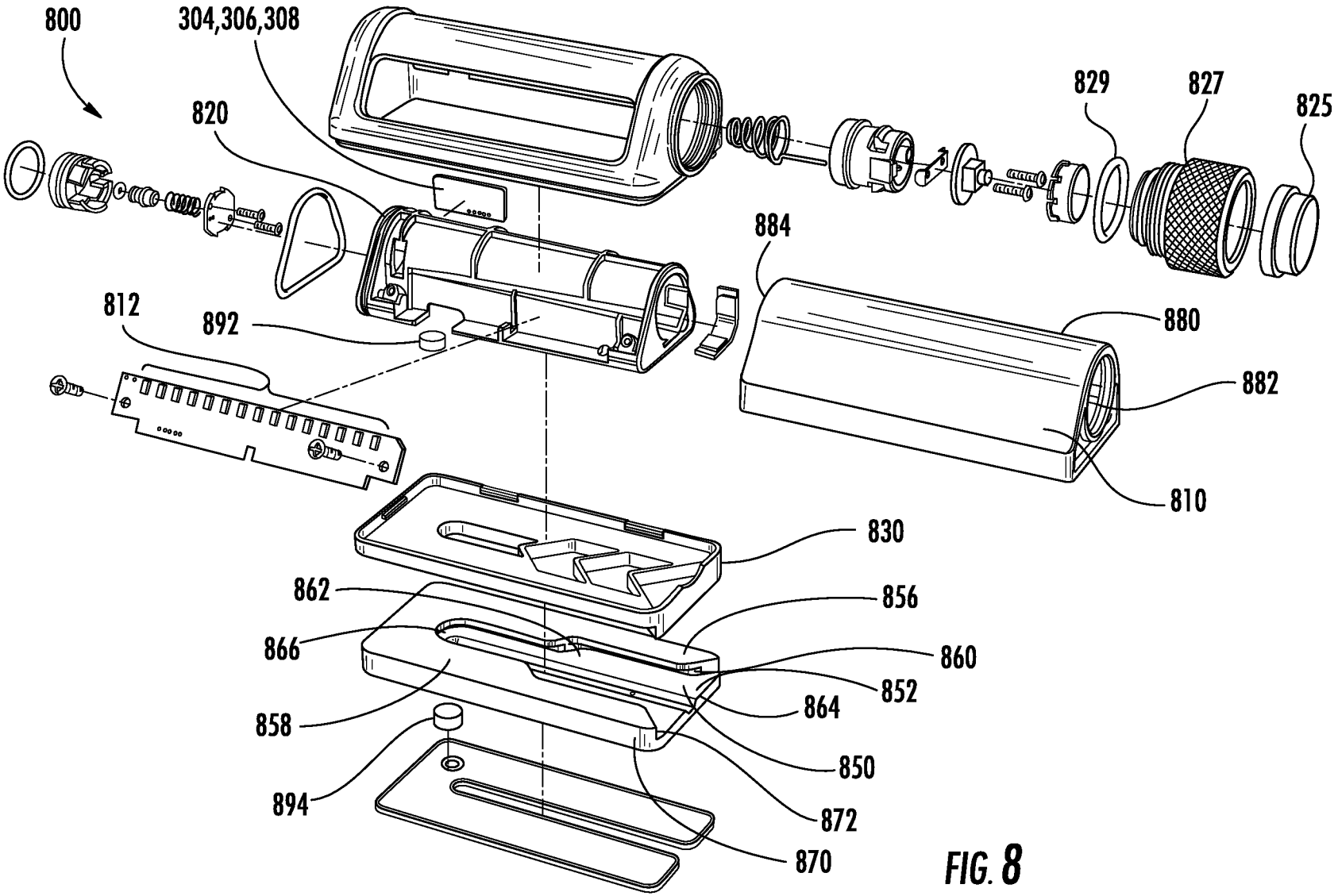
FIG. 8 depicts an isometric assembly view of an example light according to one or more aspects described herein.
Figure 9A:
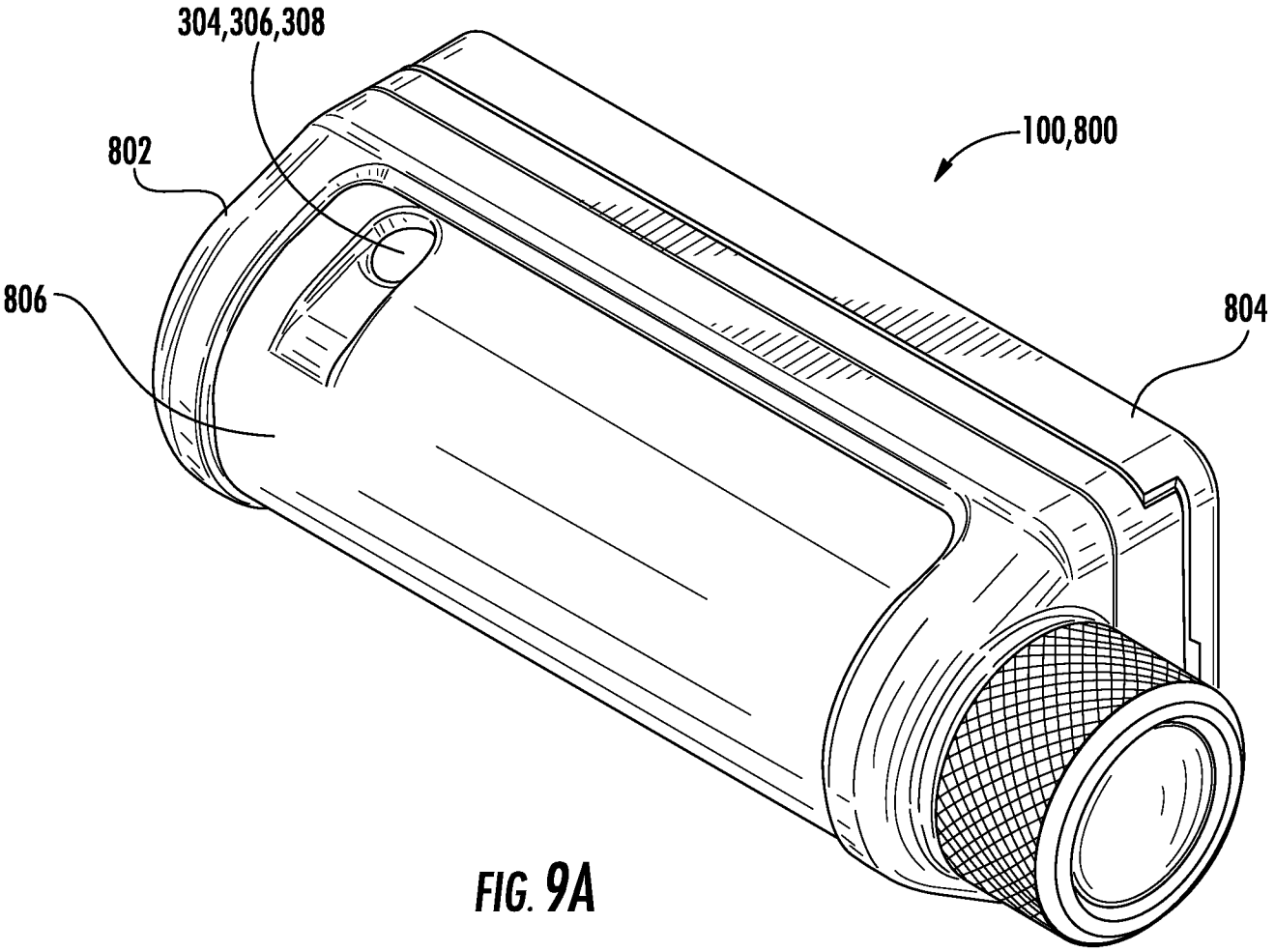
FIG. 9A depicts an isometric view of an example light according to one or more aspects described herein.
Figure 9B:
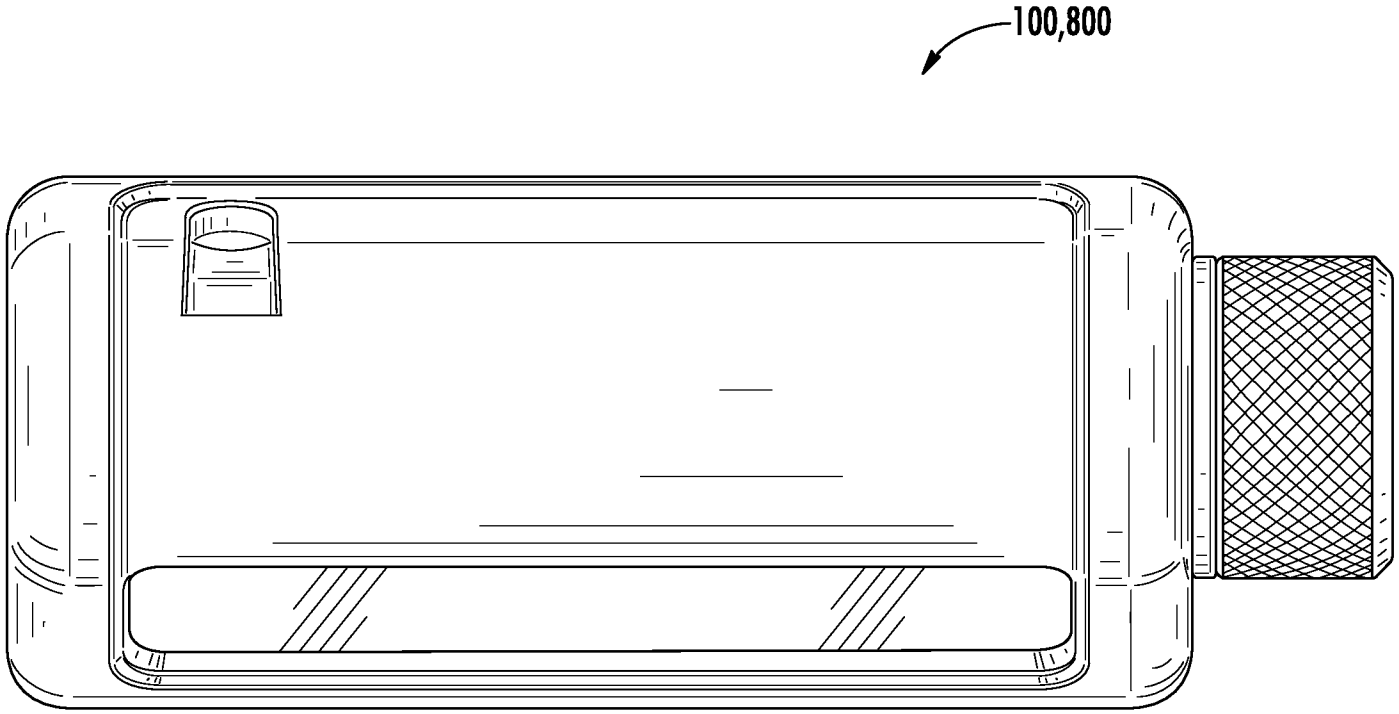
FIG. 9B depicts a top view of the example light of FIG. 9A, according to one or more aspects described herein.
Figure 9C:
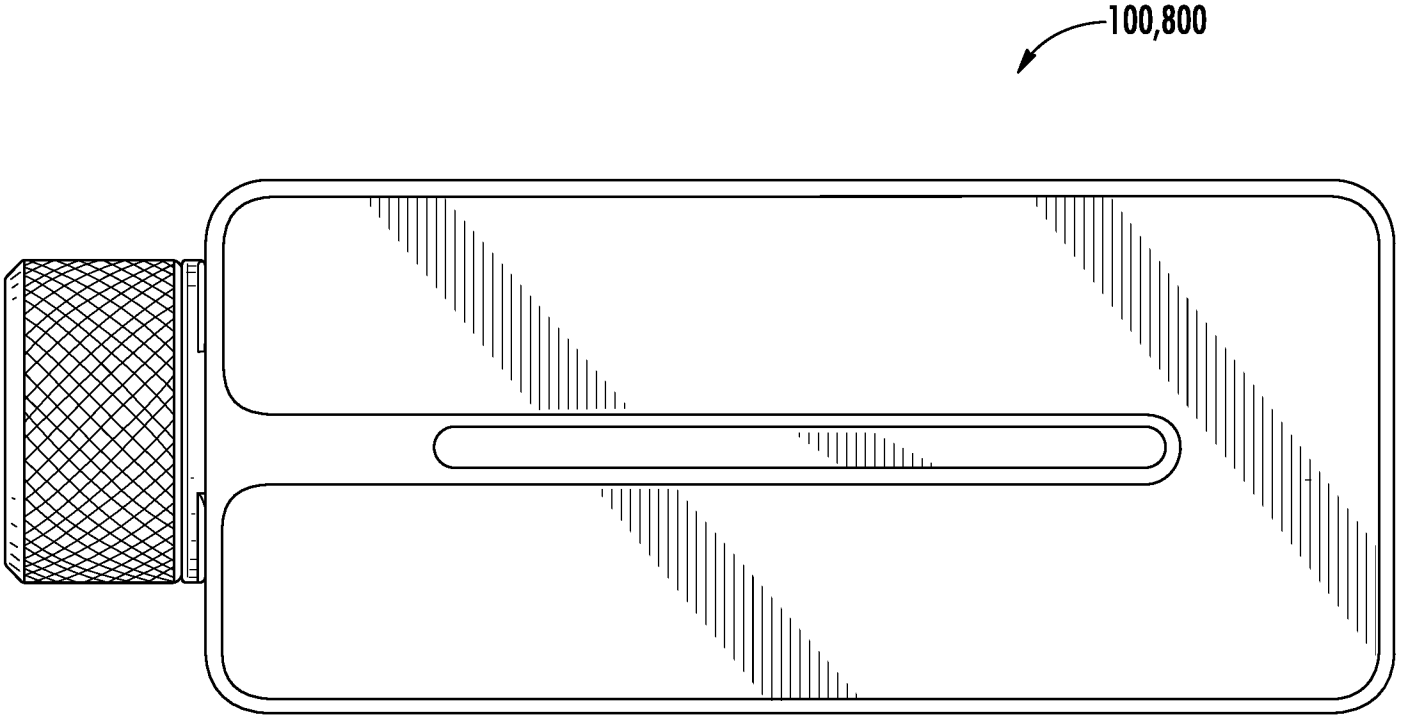
FIG. 9C depicts a bottom view of the example light of FIG. 9A, according to one or more aspects described herein.
Figure 9E:
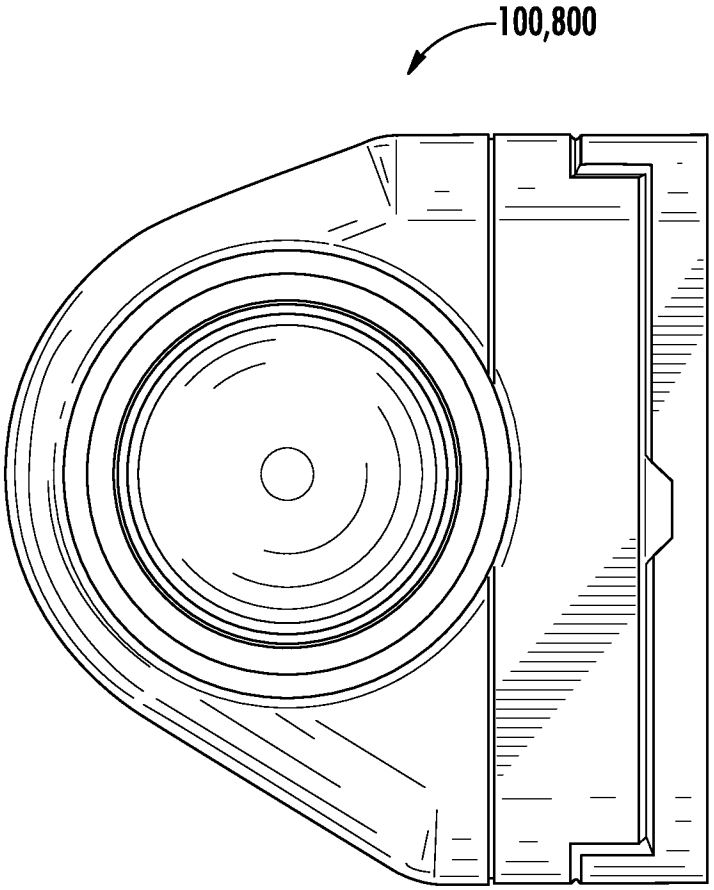
FIG. 9E depicts a right side view of the example light of FIG. 9A, according to one or more aspects described herein.
Figure 9D:
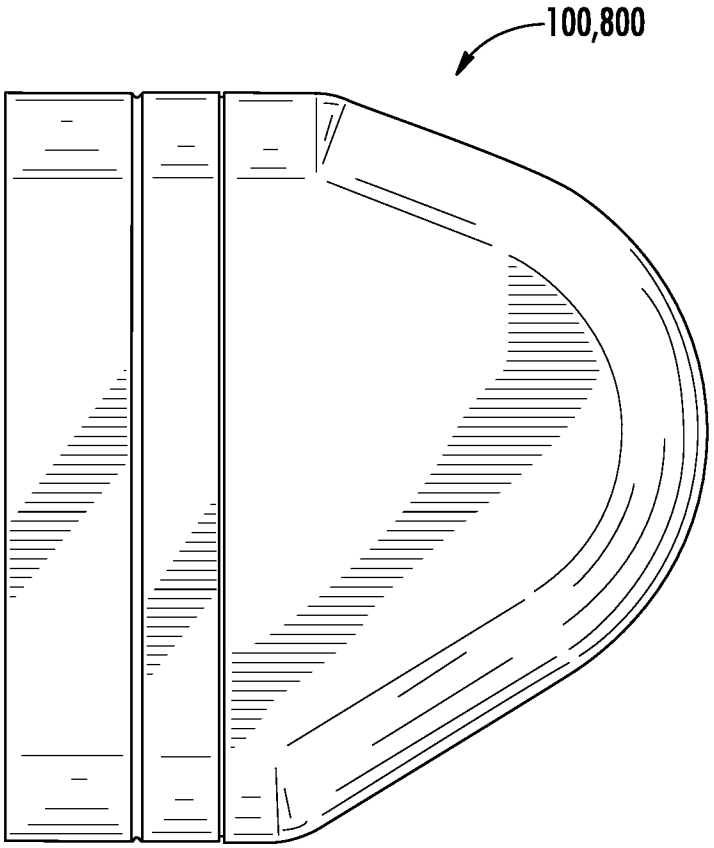
FIG. 9D depicts a left side view of the example light of FIG. 9A, according to one or more aspects described herein.
Figure 9F:
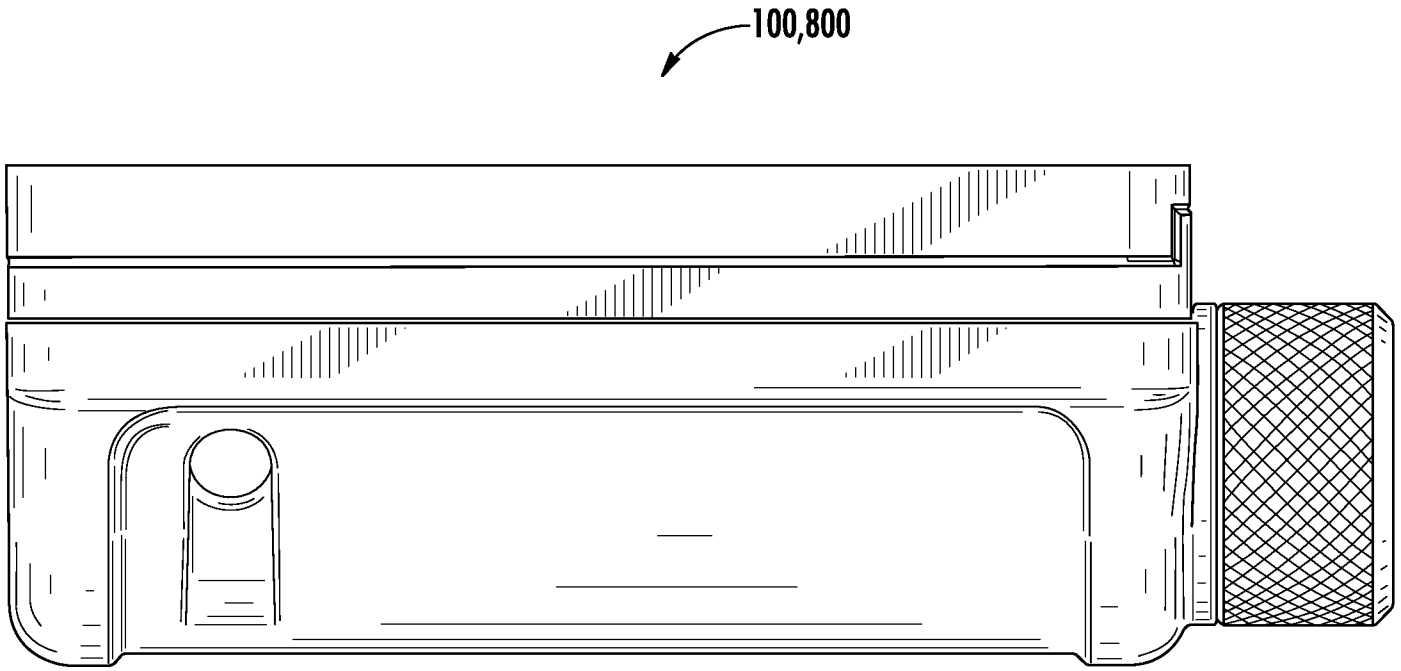
FIG. 9F depicts a back side view of the example light of FIG. 9A, according to one or more aspects described herein.
Figure 9G:
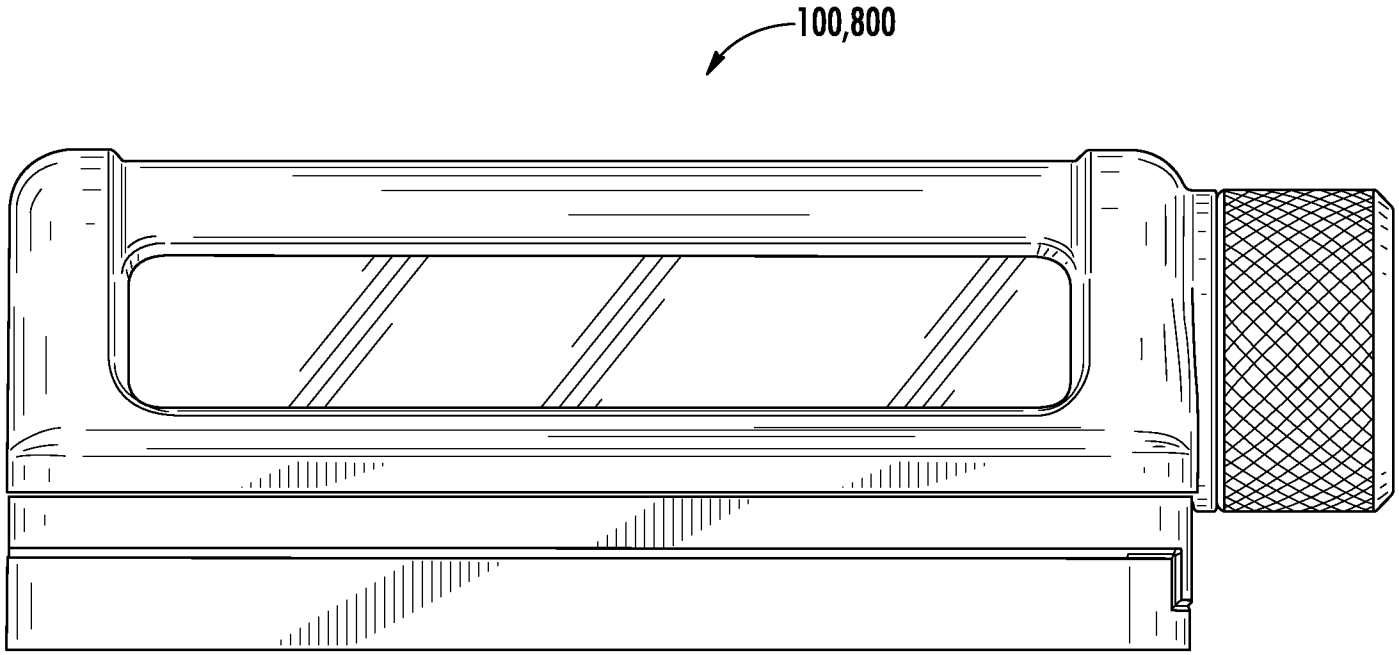
FIG. 9G depicts a front side view of the example light of FIG. 9A, according to one or more aspects described herein.

In some embodiments, the light 100 may have a different internal structure. For example, FIG. 8 depicts another example light 800 similar to light 100, wherein like reference numerals refer to the same or similar elements in light 100 but include 800 series reference numerals. FIG. 8 depicts an assembly view of example light 800, according to one or more aspects described herein. Example light 800 is similar to example light 100, however, example light 800 includes an internal lens housing 880.

As with light 100, light 800 includes a housing portion 802, a base portion 804, and an internal frame 820. The internal frame 820 may engage electrical components of the light 800 including, for example, the power control board, the light source 112, sensors 304, 306, 308, power source 126, and push button switch 825. The internal frame 820 may generally be sized to fit within the internal lens housing portion 880 which itself is sized to fit within the housing portion 806.

As shown in FIG. 8, the internal lens housing 880 may be constructed of a single or integral piece. The internal lens housing 880 may have a first opening at a first end 882 and second opening at a second end 884. The second opening at the second end 884 may be configured to allow insertion of the internal frame 820. In use, each of the first end 882 and the second end 884 may be sealed such that the internal lens housing is waterproof. The internal lens housing may be made or at least partially made of translucent or transparent material such that the light source 112 may shine through the internal lens housing 880. As shown in FIG. 8, the lens 810 may be integrally formed with the internal lens housing 880. The internal lens housing 880 may be integrally formed of polycarbonate or another similar material. In some embodiments, the internal lens housing 880 may provide an additional barrier to water, thus creating a waterproof or water-resistant seal. Thus, in some embodiments, the internal lens housing 880 may be manufactured such that it is waterproof when tested for 30 minutes under 1 meter of water. In some embodiments, the light 800 having internal lens housing 880 may be capable of achieving an IPX7 (as set forth by International Electrotechnical Commission) rating which specifies that ingress of water in harmful quantities is not possible when the enclosure is immersed in water under defined conditions of pressure and time (up to 1 m of submersion). The IPX7 test is 30 minutes long and the enclosure is tested with the lowest point of the enclosure 1000 mm below the surface of the water, or the highest point 150 mm below the surface whichever is deeper.

As shown in FIG. 8, the light 800 may also include one or more magnets 892 to assist in holding the housing portion 802 to the base portion 804. As shown in FIG. 8, the light may include a first magnet 892 engaged with the housing portion and a second magnet engaged with the base portion 894. These magnets 892, 894 may act to hold the housing portion 802 engaged with the base portion 804.

As described above, and as will be described in more detail below, the light emitting source 112 may be configured to automatically turn on when the lid 201 is opened a predetermined amount. This may allow a user to more easily see inside the container when ambient light conditions are low. To allow the light 100 to automatically turn on when the lid is opened, the light 100 may include one or more sensors or other components.

Figure 5A:
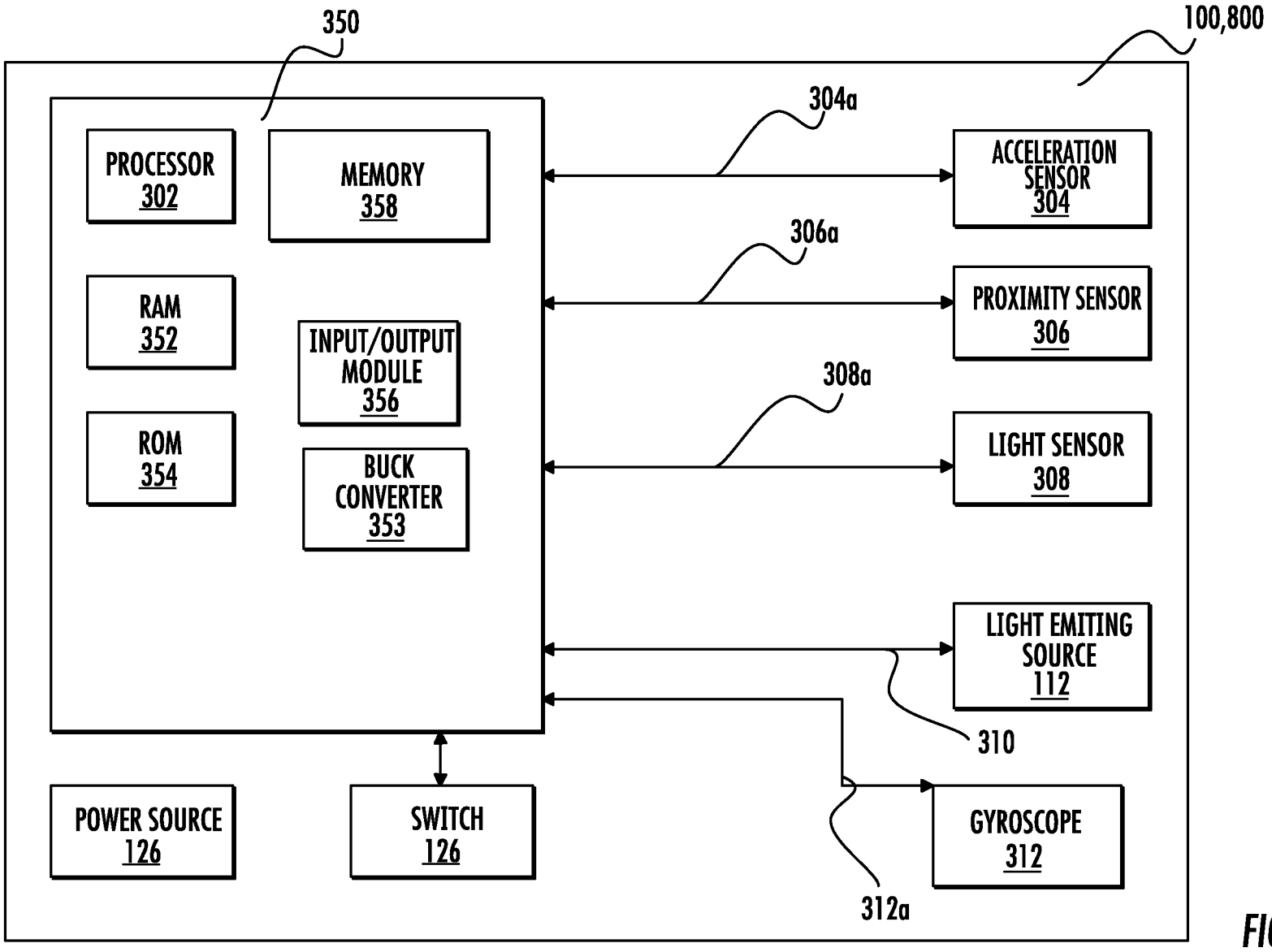
FIG. 5A illustrates a schematic view of elements of another example light according to one or more aspects of the disclosure.

For example, as schematically shown in FIG. 5A, the light 100 can include a number of components that can be used to control the operation of the light 100. The light 100 can include one or more processors 302 for controlling overall operation of the light 100. In embodiments, the light 100 may also include an acceleration sensor or accelerometer 304, a proximity sensor 306, and a light sensor or photosensor 308. In other embodiments, the light 100 may also include a gyroscope or gyrometer 312. Additionally, as described above, the light 100 may also include a power source 126, such as a battery, a switch 125, and a light emitting source 112 such as an LED array. Each of these components 302, 304, 306, 308, 312, 126, 125, and 112 may be connected through circuitry 310.

As described above, the light emitting source 112 may be engaged with a container lid 201 and may automatically turn on when the container lid 201 is opened. The light 100 includes a power source 126 for providing power to the light 100 and includes a control unit 350 for controlling the light 100.

As shown in FIG. 5A, the control unit 350 can include a number of components that can be used to control the light 100. The control unit 350 can include one or more processors 302 for controlling overall operation of the light 100 and its associated components which can include buck converter 353, RAM 352, ROM 354, input/output module 356, and memory unit 358. In embodiments, the control unit 350, through the I/O module 356, can control the operation of the light emitting source 112. For example, and as described above, the I/O module 356 can receive inputs from at least the acceleration sensor 304, the proximity sensor 306, and the light sensor 308. Additionally, in embodiments with a gyroscope 312, the I/O module 356 may receive inputs from gyroscope 312.

Software may be stored within memory unit 358 and/or other storage to provide instructions to the processor(s) 302 for enabling the light 100 to perform various functions. For example, and as will be described in greater detail below, software may be stored in the memory unit 358 to enable the light emitting source 112 to automatically turn on when an insulating device lid 201 is opened. The memory unit 358 can include one or more of volatile and/or non-volatile computer memory to store computer-executable instructions, data, and/or other information.

Generally, the acceleration sensor 304 allows for detection of movement of the light 100.

The acceleration sensor 304 can be configured to detect rotation of the light 100 and/or rotation of the container lid 201 to which the light 100 is attached. For example, when the light 100 is engaged with a lid 201, as shown in FIG. 6, the acceleration sensor 304 can detect the rotation of the light 100 as the lid 201 is opened. In other examples, the acceleration sensor can measure orientation, shock, or vibration depending on the type of acceleration sensor and desired signal input to the control unit. The acceleration detection from the acceleration sensor 304 can be transmitted to the input/output module 356 located within the control unit 350 via circuit 304*a*. The data/information received by the control unit 350 from the acceleration sensor 304 can be processed by means of suitable algorithms based on program code stored in the memory 358 to control the light 100.

Generally, the proximity sensor 306 allows for detection of the proximity of an object close to the light 100. The proximity sensor 306 can be configured to detect a wall or other similar structure. For example, when the light 100 is engaged with a lid 201 as shown in FIG. 6, the proximity sensor 306 can detect an inside surface 204 (including inside surfaces 204*a*, 204*b*, 204*c*, or 204*d*) of the insulating device 200. The proximity detection from the proximity sensor 306 can be transmitted to the input/output module 356 located within the control unit 350 via circuit 306*a*. The data/information received by the control unit 350 from the proximity sensor 306 can be processed by means of suitable algorithms based on program code stored in the memory 358 to control the light 100.

Generally, the light sensor 308 allows for detection of ambient light around the light 100. For example, when the light 100 is engaged with a lid 201 as shown in FIG. 6, the light sensor 308 can detect ambient light around light 100. The ambient light detection from the light sensor 308 can be transmitted to the input/output module 356 located within the control unit 350 via circuit 308*a*. The data/information received by the control unit 350 from the acceleration sensor 308 can be processed by means of suitable algorithms based on program code stored in the memory 358 to control the light 100.

Generally, in embodiments that include a gyroscope 312, the gyroscope 312 may provide information related to orientation of the light. For example, when the light 100 is engaged with a lid 201, as shown in FIG. 6, the gyroscope 312 can detect the orientation of the light 100 which can be used in conjunction with the acceleration sensor 304 to detect rotation of the light 100 as the lid 201 is opened. The orientation from the gyroscope 312 can be transmitted to the input/output module 356 located within the control unit 350 via circuit 312*a*. The data/information received by the control unit 350 from the gyroscope 312 can be processed by means of suitable algorithms based on program code stored in the memory 358 to control the light 100. In certain embodiments which include a gyroscope 312, other sensors may be eliminated from the system. For example, in some embodiments that include a gyroscope 312, the proximity sensor 306 may be removed from the system.

As described above, the light emitting source 112 of the light 100 may be configured to automatically turn on when the insulating device lid 201 is opened. In some embodiments, and as described above, the light 100 may include an accelerometer 304 configured to sense rotation or opening of the insulating device or container lid 201. In some embodiments, once the accelerometer 304 has detected a predetermined amount of rotation or movement of the insulating device lid 201, the control unit 350 may be configured to turn on the light emitting source 112. The predetermined rotation of the insulating device lid 201 may be at least 10 degrees open, or at least 15 degrees open or at least 20 degrees open.

As described above, the light 100 may include additional sensors which may also control the light 100. For example, the proximity sensor 306 and/or light sensor 308 may verify that the light emitting source 112 does not turn on if, for example, the insulating device lid 201 is closed or if the insulating device lid 201 is opened in bright ambient light conditions.

As described above, the light 100 may include a proximity sensor 306 which may be configured to sense an internal surface 204 (including any one of 204*a*, 204*b*, 204*c*, and 204*d*) of the insulating device 200. The proximity sensor 306 may be configured to override the accelerometer 304 if the proximity sensor 306 senses an internal surface 204 of the insulating device. Thus, if the proximity sensor 306 senses an internal surface 204 of the insulating device 200, meaning that the insulating device lid 201 is in a closed position, the control unit 350 will not activate the light emitting source 112. Advantageously this may restrict the light 100 from turning on when insulating device lid 201 is in a closed position.

Additionally, as described above, in embodiments, the light 200 may include a light sensor 308. The light sensor 308 may be configured to sense ambient light. The light sensor 308 may also be configured to override the accelerometer 304 if the lid 201 is opened when there is a predetermined amount of ambient light. Thus, if the light sensor 308 senses an amount of ambient light greater than a predetermined amount of ambient light, the control unit 350 will not activate the light emitting source 112. Advantageously this may restrict the light emitting source 112 from turning on when the insulating device 200 is opened during daylight or when there is a high amount ambient light.

The light 100 may also include an energy savings feature which may allow the light to conserve energy by placing certain sensors in a sleep mode or hibernation state wherein the sensors utilize less energy than when in an active state. For example, in some embodiments, the proximity sensor 306 may normally be in a sleep or hibernation mode or a mode in which it is not actively sensing. The proximity sensor 306 may be configured activate and begin sensing after the accelerometer 304 senses movement of the light 100 to the predetermined amount described above. Advantageously this may conserve energy consumption of the light by reducing the amount of energy used by the proximity sensor 306.

In certain examples, the acceleration sensor 304 can be MEMS, mechanical, capacitive, or piezoelectric, or Hall-effect type. The accelerometer 304 may be sensitive to accelerations (due to gravity or otherwise) along a single axis (one-axis accelerometer), along two mutually-perpendicular axes (a 2-axis accelerometer), or along three mutually-perpendicular axes (a 3-axis accelerometer). In certain examples, the proximity sensor 306 can be capacitive, inductive, magnetic, photocell, sonar, ultrasonic, infrared, or Hall-effect type. The proximity detection of the sensor may be adjustable from under about 1 cm to over about 50 cm. The light sensor 308 can be, for example, a photodiode type sensor.

Figure 5B:
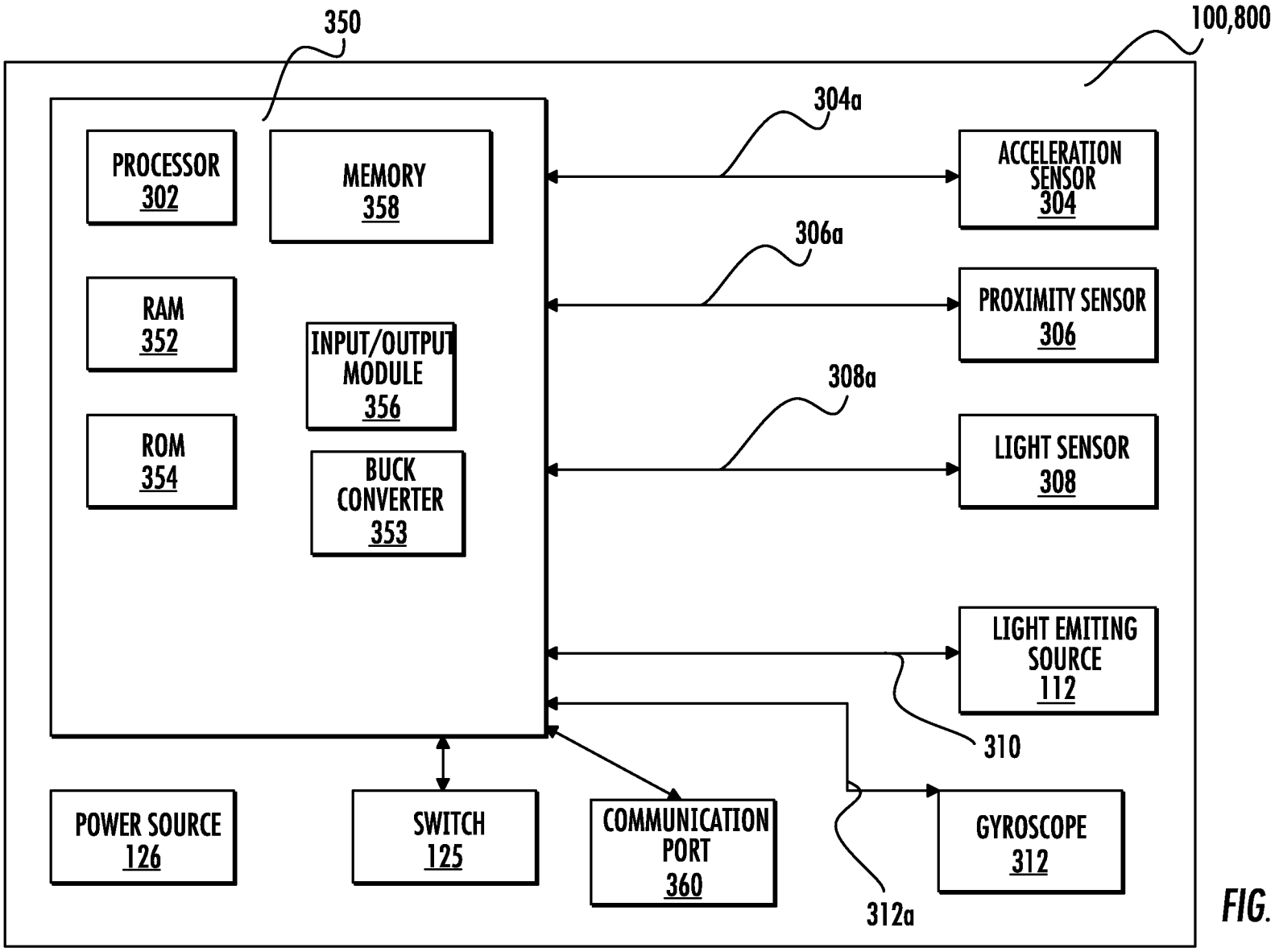
FIG. 5B illustrates a schematic view of elements of another example light according to one or more aspects of the disclosure.

In some embodiments, as shown in FIG. 5B, the light 100, can include one or more ports 360, such as USB port and/or Ethernet port for sending and receiving information. Such ports can provide information to the input/output module 356 and in some embodiments can be used to change or update the programming of the light 100.

Figure 7:
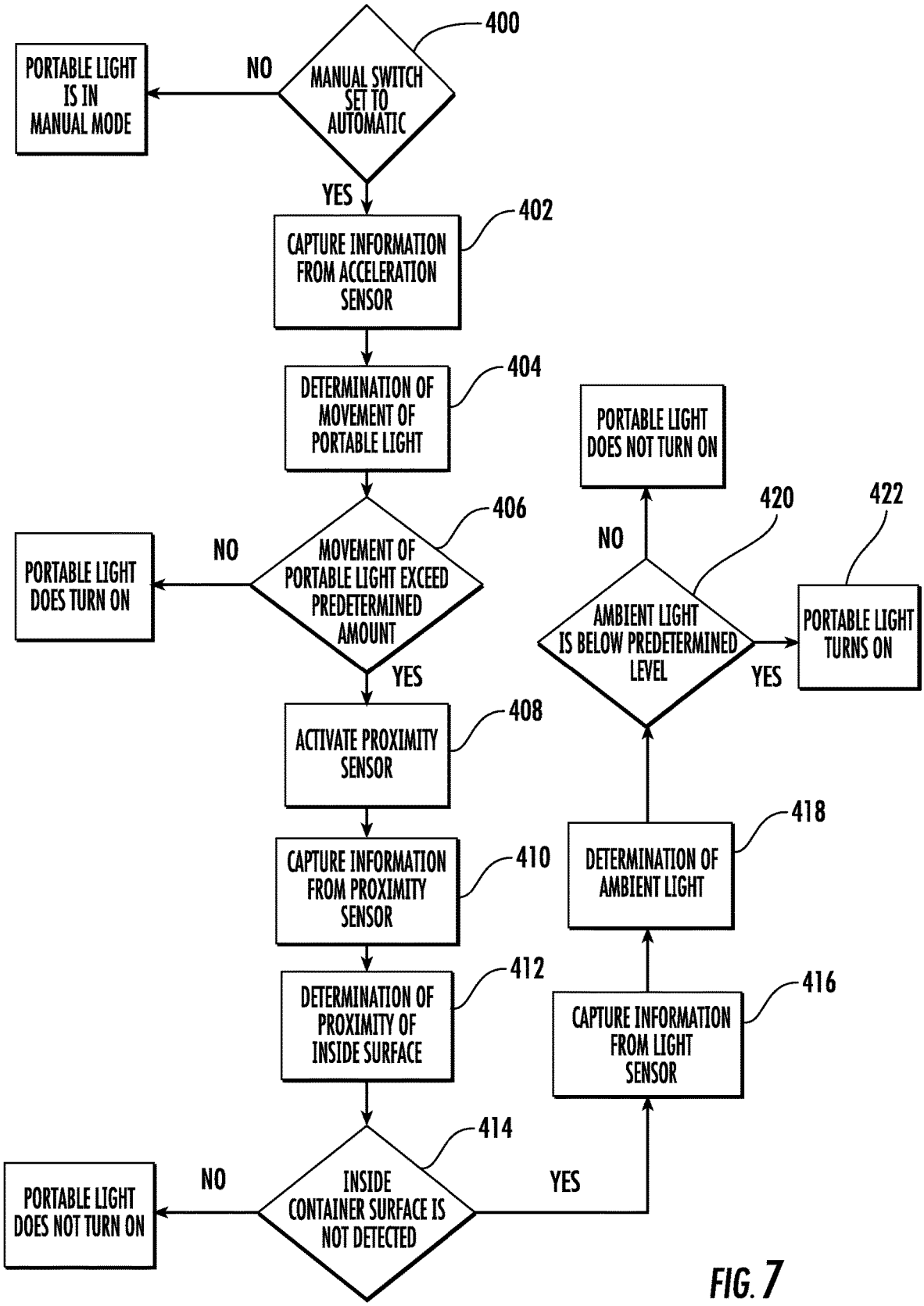
FIG. 7 illustrates an example process for controlling a light according to one or more aspects of this disclosure.

FIG. 7 illustrates an exemplary process for controlling the light 100. The method starts with step 400 which determines whether the switch 125 is set to the automatic position. If the switch 125 is set to the automatic position, the method proceeds to step 402 in which information is captured from the acceleration sensor 304.

The method next proceeds to step 404 an analysis of the information from the acceleration sensor 304. Then, in step 406 the method performs a test to determine if movement of the light 100 has exceeded a predetermined amount. As described above, this predetermined amount can be at least 10 degrees, at least 15 degrees, or at least 20 degrees as described above. If the movement of the light 100 has exceeded this predetermined amount, then the method continues to step 408 in which the proximity sensor 306 is activated.

Once the proximity sensor 306 has been activated, the method proceeds to step 410 and 412 in which information from the proximity sensor is captured and then analyzed. In step 414, if the proximity sensor does not sense an internal wall 204 of the insulating device 200 or other container then the method proceeds to step 416.

In steps 416 and 418 information from the light sensor 308 is captured and then analyzed. In step 420 if the amount of light sensed by the light sensor 308 is below a certain amount the method continues to step 422 in which the light is activated.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

The invention claimed is:

1. A light and container system comprising:
- a container system comprising:
  - a base portion of a container having at least one inside surface; and
  - a lid portion rotatable between an open position and a closed position, the lid portion rotatably engaged with the base portion of the container;
- a light comprising:
  - a base portion of a light, and
  - a housing portion removably engaged with the base portion of the light, the housing portion comprising:
    - a switch having a first position and a second position;
    - a light emitting source;
    - an acceleration sensor, configured to determine data related to movement of the light;
    - a proximity sensor, configured to determine data related to proximity of at least one object to the light;
    - a light sensor, configured to determine data related to ambient light;
    - a control unit configured to receive the data from each of the acceleration sensor, proximity sensor, and light sensor and configured to send instructions to the light emitting source; and
    - wherein the control unit is configured to automatically activate the light emitting source in response to data received from at least one of the acceleration sensor, proximity sensor, and light sensor when the switch is in the first position and wherein the light emitting source is configured to remain deactivated if the proximity sensor senses an inside surface of the container.

2. The light and container system of claim 1, wherein the light emitting source is a light emitting diode array.

3. The light and container system of claim 1, wherein the light emitting source is configured to activate when the switch is in the second position.

4. The light and container system of claim 1, wherein the base portion of the light is engaged with the container lid using adhesive.

5. The light and container system of claim 1, wherein the base portion of the light is engaged with the container lid using mechanical fasteners.

6. The light and container system of claim 1, wherein the container system is a insulating device.

7. The light and container system of claim 1, wherein the housing portion of the light is configured to removably engage the base portion of the container with at least one of: press fitting, snap fit mechanisms, or interference fit mechanisms.

8. The light and container system of claim 1, wherein the housing portion of the light is configured to removably engage the base portion of the container with magnets.

9. The light and container system of claim 1, wherein the light emitting source is configured to activate when the container lid is opened to a predefined angle and wherein the predetermined angle is determined based on data received from the acceleration sensor.

10. The light and container system of claim 9, wherein the predetermined angle is at least 15 degrees.

11. The light and container system of claim 9, wherein the light emitting source is configured to remain deactivated if the proximity sensor senses an inside surface of the container.

12. The light and container system of claim 11, wherein the light emitting source is configured to remain deactivated if the light sensor senses a predetermined amount of ambient light.

13. The light and container system of claim 12, wherein at least one of the acceleration sensor, proximity sensor, and light sensor are configured to operate in a hibernation state wherein the sensor uses less power as compared to a use state until a predetermined signal is received from the control unit.

14. The light and container system of claim 13, wherein the proximity sensor is configured to normally operate in a hibernation mode where the proximity sensor does not determine data related to proximity of objects to the light; wherein the proximity enters a use state wherein once a predefined signal is received the proximity sensor determines data related to proximity of objects to the light; and wherein the predetermined signal is data related to the predetermined angle of the container lid.

15. A light comprising:

a base portion, and a housing portion removably engaged with the base portion, the housing portion comprising:

a light emitting diode array;

an acceleration sensor, configured to determine data related to movement of the light;

a proximity sensor, configured to determine data related to proximity of at least one object to the light;

a light sensor, configured to determine data related to ambient light; and a control unit configured to receive the data from each of the acceleration sensor, proximity sensor, and light sensor and configured to output a signal to the light emitting diode array; and a switch having a first position and a second position wherein the control unit is configured to automatically activate the light emitting diode array in response to data received from at least one of the acceleration sensor, proximity sensor, and light sensor when the switch is in the first position, and wherein the light emitting diode array is configured to remain deactivated if the proximity sensor senses an inside surface of a container.

16. The light of claim 15, wherein the light emitting diode array is configured to activate when the light is moved a predefined displacement and wherein the predetermined displacement is determined based on data received from the acceleration sensor.

17. The light of claim 15, wherein the light emitting diode array is configured to remain deactivated if the light sensor senses a predetermined amount of ambient light.

18. The light of claim 16, wherein the proximity sensor is configured to normally operate in a hibernation mode where the proximity sensor does not determine data related to proximity of objects to the light; wherein once a predefined signal is received, the proximity enters a use state where the proximity sensor determines data related to proximity of objects to the light; and wherein the predetermined signal is data related to the predetermined distance.

* * * * *